US010989151B2

(12) United States Patent
Kim

(10) Patent No.: US 10,989,151 B2
(45) Date of Patent: Apr. 27, 2021

(54) EXHAUST GAS COOLER FOR VEHICLE

(71) Applicants: Hyundai Motor Company, Seoul (KR); Kia Motors Corporation, Seoul (KR)

(72) Inventor: Jong Cheon Kim, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/659,766

(22) Filed: Oct. 22, 2019

(65) Prior Publication Data

US 2020/0392925 A1 Dec. 17, 2020

(30) Foreign Application Priority Data

Jun. 12, 2019 (KR) ..... 10-2019-0069578

(51) Int. Cl.
*F02M 26/29* (2016.01)
*F02M 26/32* (2016.01)

(52) U.S. Cl.
CPC ..... *F02M 26/29* (2016.02); *F02M 26/32* (2016.02)

(58) Field of Classification Search
CPC ..... F02M 26/32; F02M 26/29
See application file for complete search history.

(56) References Cited

U.S. PATENT DOCUMENTS

2016/0116222 A1* 4/2016 Shedd ..... F28F 9/0263 165/166

* cited by examiner

*Primary Examiner* — Brandon D Lee
(74) *Attorney, Agent, or Firm* — Mintz Levin Cohn Ferris Glovsky and Popeo, P.C.; Peter F. Corless

(57) ABSTRACT

A cooler for a vehicle that is configured to cool an exhaust gas exhausted from an engine of the vehicle includes: a cooler housing in which a coolant flow path and a plurality of tubes forming an exhaust gas flow path are formed. Each of the tubes includes micro fins that have a constant pattern formed along a length direction and are formed along an outer circumference surface of each of the tubes. A height of each of the micro fins is less than or equal to about 200 μm.

9 Claims, 7 Drawing Sheets

EXHAUST GAS COOLER FOR VEHICLE

CROSS-REFERENCE TO RELATED APPLICATION

This application claims under 35 U.S.C. § 119(a) the benefit of Korean Patent Application No. 10-2019-0069578 filed in the Korean Intellectual Property Office on Jun. 12, 2019, the entire contents of which are incorporated herein by reference.

BACKGROUND

(a) Technical Field

The present disclosure relates to a vehicle cooler, more particularly, to an exhaust gas cooler for a vehicle capable of reducing an overall size thereof while increasing heat capacity.

(b) Description of the Related Art

In general, a heat exchanger of a vehicle transfers heat from a high temperature fluid to a low temperature fluid through an insulator, and is used for a heater, a cooler, an evaporator, and a condenser.

The heat exchanger reuses heat energy, adjusts a temperature of an inflowing fluid, and is usually installed in an engine room.

Exhaust gas of the vehicle contains a large amount of harmful materials such as carbon monoxide, nitrogen oxide, and hydrocarbon.

A harmful material such as nitrogen oxide is generated at a higher engine temperature. An exhaust gas recirculation (EGR) system is used in order to reduce the presence of harmful materials. In the EGR system, the exhaust gas is recycled to an intake system for an engine of the vehicle so that the harmful material is reduced by lowering combustion temperature in a cylinder of the engine.

The EGR system is a type of heat exchanger that includes an exhaust gas recirculation (EGR) cooler that cools a high temperature exhaust gas using a coolant.

The EGR cooler prevents excessive temperature rise of the exhaust gas by mutually exchanging the exhaust gas and the coolant.

In the EGR cooler, a plurality of tubes are installed in the cooler housing in which a coolant flow path is formed. An exhaust gas flow path is formed inside each of the tubes.

The EGR system is mounted in the engine room having a limited space so that there is a difficulty in mounting the EGR system. Therefore, research and development for miniaturization, weight reduction, high efficiency, and high functionalization of the EGR system are required.

The above information disclosed in this Background section is only for enhancement of understanding of the background of the disclosure, and therefore it may contain information that does not form the prior art that is already known in this country to a person of ordinary skill in the art.

SUMMARY

The present disclosure provides a cooler for a vehicle capable of increasing heat capacity by applying a micro fin to a surface of a tube in contact with a coolant to maximize heat exchange area.

An exemplary embodiment of the present disclosure may provide the cooler for the vehicle that cools an exhaust gas exhausted from an engine of the vehicle, including: a cooler housing in which a coolant flow path and a plurality of tubes forming an exhaust gas flow path are formed. Each of the tubes may include micro fins that have a constant pattern formed along a length direction and are formed along an outer circumference surface of each of the tubes. A height of each of the micro fins may be less than or equal to about 200 μm.

The micro fins each may include at least a depression and a protrusion that have a polygonal shape.

The depression and the protrusion of each of the micro fins may be formed in a repeating pattern of a plurality of continuous depressions and protrusions The depression and the protrusion of each of the micro fins may include a horizontal side and a vertical side so that the depression and the protrusion have a rectangular shape.

The depression and the protrusion of each of the micro fins may include a horizontal side and a vertical side so that the depression and the protrusion have a rectangular shape of which each corner has a round shape.

The depression and the protrusion of each of the micro fins may include a horizontal side and an inclined side so that the depression and the protrusion have a trapezoid shape.

A height of the protrusion of each of the micro fins may be set in a range of about 30 μm to 200 μm.

A length direction of each of the micro fins may be equal to a flow direction of the coolant flow path.

The coolant flow path may be formed between the cooler housing and each of the tubes and between the micro fins adjacent to each other.

Each of the tubes may be made of stainless material.

The tubes may be stacked at regular intervals through headers and may be bonded at the headers.

The cooler for the vehicle according to the exemplary embodiment of the present disclosure may increase the heat exchange area by integrally forming a micro fin on an outer surface of the tube in contact with a coolant flow path so that the exemplary embodiment of the present disclosure increases the heat capacity.

Further, the exemplary embodiment of the present disclosure may increase thermal efficiency by increasing a flow rate on a heat exchange surface and forming a turbulent flow through the micro fin.

In addition to the aforementioned advantageous effect, an effect that may be obtained or anticipated by applying an exemplary embodiment of the present disclosure will be disclosed explicitly or implicitly in the detailed description of the exemplary embodiment of the present disclosure. In other words, various effects expected by applying an exemplary embodiment of the present disclosure will be disclosed within the detailed description to be provided later.

DETAILED DESCRIPTION OF THE EMBODIMENTS

Figure 1:
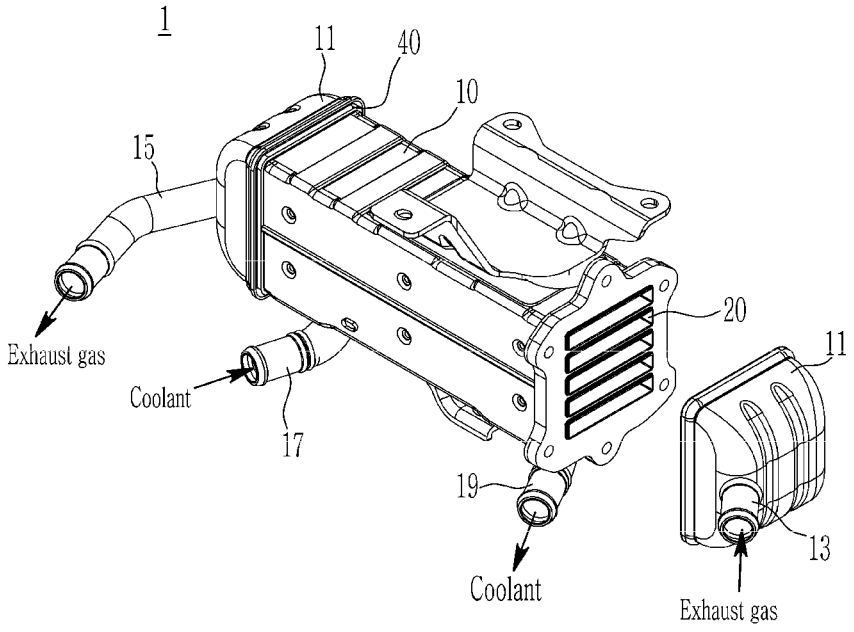
FIG. 1 is a perspective view of an exhaust gas recirculation (EGR) system for a vehicle according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

The present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure.

Accordingly, the drawings and description are to be regarded as illustrative in nature and not restrictive. Like reference numerals designate like elements throughout the specification.

Figure 2:
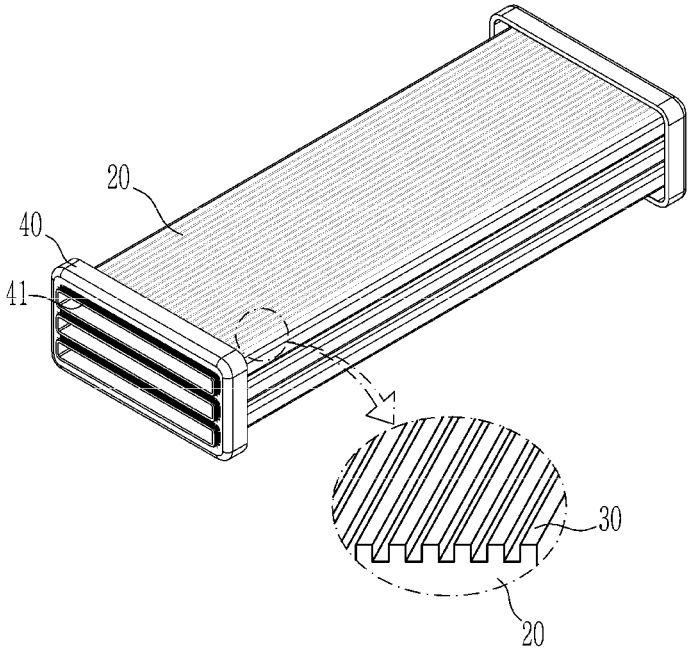
FIG. 2 is a perspective view of a cooler for a vehicle according to an exemplary embodiment of the present disclosure.

FIG. 1 is a perspective view of an exhaust gas recirculation (EGR) system for a vehicle according to an exemplary embodiment of the present disclosure. FIG. 2 is a perspective view of a cooler for a vehicle according to an exemplary embodiment of the present disclosure. FIGS. 3A to 3D are views for explaining a shape of a micro fin applied to the vehicle cooler according to an exemplary embodiment of the present disclosure. FIG. 4 is a view showing a relationship between the micro fin and a coolant flow path applied to the vehicle cooler according to an exemplary embodiment of the present disclosure.

A structure of the micro fin applied to the cooler for the vehicle according to the exemplary embodiment of the present disclosure may be applied to various heat exchangers. The micro fin may be formed in a portion or a position in contact with a coolant (e.g., a cooling water) passing through a heat exchanger.

For example, the heat exchanger may include a radiator, a heater core, a condenser, or a cooler.

Referring to FIG. 1, the cooler for the vehicle according to the exemplary embodiment of the present disclosure may be an exhaust gas recirculation (EGR) cooler applied to the EGR system disposed between an exhaust manifold and an intake manifold.

The EGR cooler 1 may lower combustion temperature in a cylinder of an engine of the vehicle by recirculating part of an exhaust gas from the engine to the intake manifold so that the EGR cooler suppresses generation of nitrogen oxide.

The EGR cooler 1 may include a cooler housing 10. The cooler housing 10 may include a gas inflow tube 13 connected to the exhaust manifold and a gas exhaust tube 15 connected to the intake manifold. The gas inflow tube 13 and the gas exhaust tube 15 may be formed at covers 11 that are both end portions of the cooler housing 10.

A coolant inlet 17 and a coolant outlet 19 may be formed on one side of the cooler housing 10. The coolant flow path inside the cooler housing 10 may be connected to the coolant inlet 17 and coolant outlet 19.

A plurality of tubes 20 may be stacked at regular intervals inside the cooler housing 10. The exhaust gas flow path may be formed inside each of the tubes.

Referring to FIG. 2, the tube 20 may be made of stainless material to have a box shape with both ends thereof open.

The tube 20 may be fixed by headers 40 disposed on both sides thereof. A plurality of penetration holes 41 may be formed in each of the headers 40 in order to insert the tube 20 in the penetration holes.

In other words, the tubes 20 may be inserted at a predetermined interval in the penetration holes 41 of the header 40 and then may be bonded on the penetration holes.

The tubes 20 stacked through the headers 40 may be assembled inside the cooler housing 10.

The tube 20 may include a plurality of micro fins 30 that have a constant pattern formed along a length direction and are integrally formed along an outer circumference surface thereof. A height of each of the micro fins 30 may be less than or equal to about 200 μm.

Although the micro fins 30 are described as being formed only on an outer surface of the tube 20 as an example, the present disclosure is not limited thereto, and the micro fins 30 may be formed on an inner surface and the outer surface.

In other words, the micro fins 30 may be formed on the inner surface in contact with the exhaust gas flow path as well as on the outer surface in contact with the coolant flow path so that the micro fin increases a surface area in contact with the exhaust gas.

The micro fins 30 may include a plurality of continuous depressions and protrusions that have a polygonal shape or a polygonal section shape.

Referring to FIGS. 3A to 3D, a depression and a protrusion of each of the micro fins 30 may have a predetermined width and height.

Figure 3A:
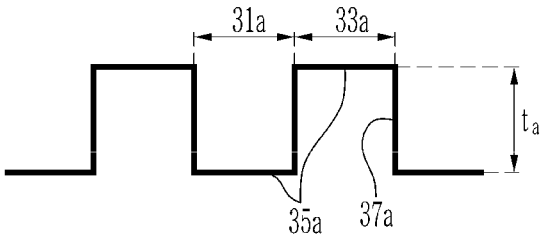
FIGS. 3A to 3D are views for explaining a shape of a micro fin applied to the vehicle cooler according to an exemplary embodiment of the present disclosure.
Figure 4:
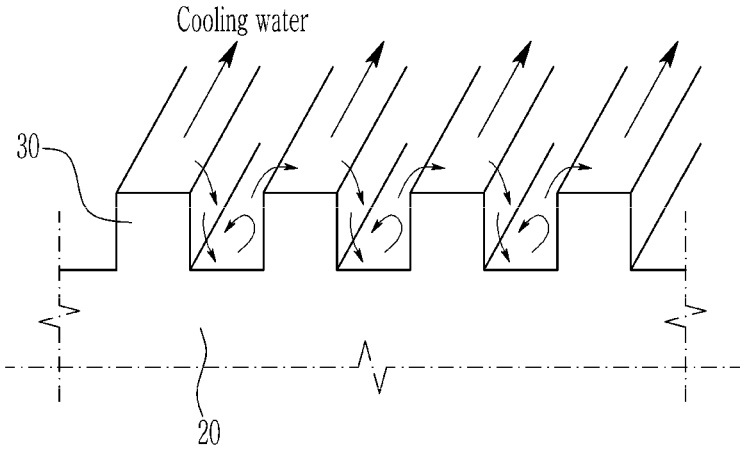
FIG. 4 is a view showing a relationship between the micro fin and a coolant flow path applied to the vehicle cooler according to an exemplary embodiment of the present disclosure.

Referring to FIG. 3A, a depression 31*a* and a protrusion 33*a* of each of the micro fins 30 may include a horizontal side 35*a* and a vertical side 37*a* so that the depression 31*a* and the protrusion 33*a* have a rectangular shape or a rectangular section shape.

In other words, the horizontal side 35*a* and the vertical side 37*a* may be continuously connected in the micro fin 30 so that a corner where the horizontal side and the vertical side meet has a right angle shape.

A height $t_a$ of the protrusion 33*a* of the micro fin 30 may be set in a range of about 30 μm to 200 μm.

Figure 3B:
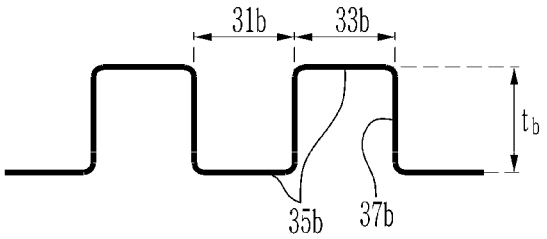

Referring to FIG. 3B, a depression 31*b* and a protrusion 33*b* of the micro fin 30 may include a horizontal side 35*b* and a vertical side 37*b* so that the depression and the protrusion have a rectangular shape or a rectangular section shape of which each corner has a round shape.

In other words, the horizontal side 35*b* and the vertical side 37*b* may be continuously connected in the micro fin 30 so that a corner where the horizontal side and the vertical side meet has a round shape.

A height $t_b$ of the protrusion 33*b* of the micro fin 30 may be set in a range of about 30 μm to 200 μm.

Figure 3C:
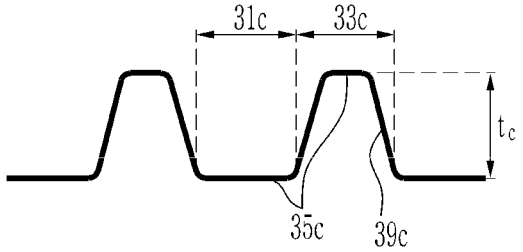

Referring to FIG. 3C, a depression 31*c* and a protrusion 33*c* of the micro fin 30 may include a horizontal side 35*c* and an inclined side 39*c* so that the depression and the protrusion have a trapezoid shape or a trapezoid section shape.

In other words, the horizontal side 35*c* and the inclined side 39*c* may be continuously connected in the micro fin 30 so that the depression 31*c* and the protrusion 33*c* have the trapezoid shape.

A height $t_c$ of the protrusion 33*c* of the micro fin 30 may be set in a range of about 30 μm to 200 μm.

Figure 3D:
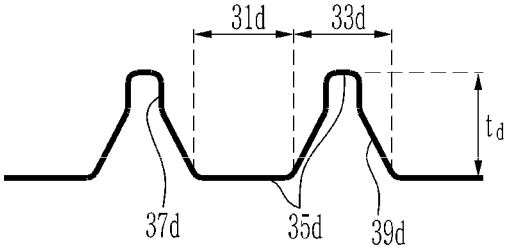

Referring to FIG. 3D, a depression 31*d* and a protrusion 33*d* of the micro fin 30 may include a horizontal side 35*d*, a vertical side 37*d*, and an inclined side 39*d* so that the depression and the protrusion have a polygonal shape.

A height $t_d$ of the protrusion 33*d* of the micro fin 30 may be set in a range of about 30 μm to 200 μm.

As described above, the micro fin 30 may have various shapes, but the heights of the protrusions 33*a* to 33*d* included in the micro fin 30 may be set in a range of about 30 μm to 200 μm.

Thus, formation of precipitate and solidification crack due to recrystallization when the tube 20 to which the micro fin 30 is applied is brazed with the header 40 that is a part of the vehicle may be prevented.

In other words, when the tube 20 including the micro fin exceeding 200 μm is brazed with the header 40, the precipitate may be formed at the brazed junction and the brazed junction may be cracked. Thus, to prevent the formation of precipitate and the crack, the height of the protrusion of the micro fin 30 may be set in a range of about 30 μm to 200 μm.

The shape of the micro fin 30 may be formed as shown in FIG. 3A to FIG. 3D, but is not necessarily limited thereto. The shape of the micro fin 30 may be changed as necessary.

Referring to FIG. 4, a length direction of the micro fin 30 may be equal to a flow direction or a length direction of the coolant flow path.

The coolant flow path may be formed between the cooler housing 10 and the tube 20, between the tubes, and between the micro fins 30 adjacent to each other.

The coolant may move between the adjacent tubes 20, between the micro fins 30, and between the cooler housing 10 and the tube. The coolant flow path may be formed between the cooler housing 10 and the tube 20 and between the micro fins 30 adjacent to each other.

A turbulent flow may be formed in the coolant flow path between the micro fins 30.

Therefore, the vehicle cooler according to an exemplary embodiment of the present disclosure may increase the heat exchange area by integrally forming the micro fin 30 on an outer surface of the tube 20 in contact with the coolant flow path so that it increases heat capacity.

The vehicle cooler may increase the heat capacity as compared with a conventional art and may reduce material costs by reducing an overall size of the cooler.

In addition, the vehicle cooler may increase thermal efficiency or heat efficiency by increasing a flow rate on a heat exchange surface and forming a turbulent flow through the micro fin 30.

While this disclosure has been described in connection with what is presently considered to be practical exemplary embodiments, it is to be understood that the disclosure is not limited to the disclosed embodiments, but, on the contrary, is intended to cover various modifications and equivalent arrangements included within the spirit and scope of the appended claims.

What is claimed is:

1. A cooler for a vehicle that is configured to cool an exhaust gas exhausted from an engine of the vehicle, comprising:

a cooler housing in which a coolant flow path and a plurality of tubes forming an exhaust gas flow path are formed, wherein each of the tubes includes micro fins that have a constant pattern linearly formed along a length direction of the tubes and are formed along an outer circumference surface of each of the tubes, and wherein a height of each of the micro fins is less than or equal to about 200 μm, and wherein each of the micro fins protrudes toward the coolant flow path such that the coolant flow path is linearly formed between and along adjacent ones of the micro fins.

2. The cooler of claim 1, wherein the micro fins each include at least a depression and a protrusion that have a polygonal shape.

3. The cooler of claim 2, wherein the depression and the protrusion are formed in a repeating pattern of a plurality of continuous depressions and protrusions.

4. The cooler of claim 2, wherein the depression and the protrusion of each of the micro fins include a horizontal side and a vertical side so that the depression and the protrusion have a rectangular shape.

5. The cooler of claim 2, wherein the depression and the protrusion of each of the micro fins include a horizontal side and a vertical side so that the depression and the protrusion have a rectangular shape of which each corner has a round shape.

6. The cooler of claim 2, wherein the depression and the protrusion of each of the micro fins include a horizontal side and an inclined side so that the depression and the protrusion have a trapezoid shape.

7. The cooler of claim 2, wherein a height of the protrusion of each of the micro fins is set in a range of about 30 μm to 200 μm.

8. The cooler of claim 1, wherein each of the tubes is made of stainless material.

9. The cooler of claim 1, wherein the tubes are stacked at regular intervals through headers and are bonded at the headers.

* * * * *